US006360742B1

(12) United States Patent
Maxwell et al.

(10) Patent No.: US 6,360,742 B1
(45) Date of Patent: Mar. 26, 2002

(54) CONNECTING DEVICE FOR A BREATHING APPARATUS

(75) Inventors: Ian Maxwell, Pulborough (GB); Håkan Hedenberg, Järfälla (SE)

(73) Assignee: Interspiro AB (SE)

( * ) Notice: Subject to any disclaimer, the term of this patent is extended or adjusted under 35 U.S.C. 154(b) by 0 days.

(21) Appl. No.: 08/894,591

(22) PCT Filed: Feb. 21, 1996

(86) PCT No.: PCT/SE96/00240

§ 371 Date: Nov. 7, 1997

§ 102(e) Date: Nov. 7, 1997

(87) PCT Pub. No.: WO96/25980

PCT Pub. Date: Aug. 29, 1996

(30) Foreign Application Priority Data

Feb. 22, 1995 (SE) ..... 9500655

(51) Int. Cl.[7] ..... A62B 9/04
(52) U.S. Cl. ..... 128/202.27; 128/205.22
(58) Field of Search ..... 128/200.24, 202.27, 128/912, 205.22; 285/190, 272

(56) References Cited

U.S. PATENT DOCUMENTS

| | | | | | |
|---|---|---|---|---|---|
| 1,092,390 | A | * | 4/1914 | Ramsey | 285/190 |
| 2,820,651 | A | * | 1/1958 | Phillips | 128/912 |
| 2,860,633 | A | * | 11/1958 | Phillips | 128/912 |
| 2,989,960 | A | * | 6/1961 | Hay | 128/912 |
| 3,098,662 | A | * | 7/1963 | Iversen | 285/190 |
| 3,219,366 | A | * | 11/1965 | Franck | 285/190 |
| 3,694,008 | A | * | 9/1972 | Slator et al. | 285/190 |
| 3,967,838 | A | * | 7/1976 | Legris | 285/190 |
| 3,978,854 | A | * | 9/1976 | Mills, Jr. | 128/912 |
| 4,392,490 | A | * | 7/1983 | Mattingly et al. | 128/202.27 |
| 4,612,929 | A | * | 9/1986 | Schubert et al. | 128/912 |
| 4,676,241 | A | * | 6/1987 | Webb et al. | 128/912 |
| 4,791,961 | A | * | 12/1988 | Nitzberg et al. | 285/272 |
| 4,852,563 | A | | 8/1989 | Gross | 128/202.27 |
| 4,974,584 | A | * | 12/1990 | Goodnoe | 128/202.27 |
| 5,275,444 | A | * | 1/1994 | Wythoff | 285/272 |
| 6,070,917 | A | * | 6/2000 | Wiebe | 285/272 |

FOREIGN PATENT DOCUMENTS

| | | |
|---|---|---|
| CH | 591256 | 9/1977 |
| DE | 3005599 | 11/1981 |

OTHER PUBLICATIONS

International Search Report WO 96/25980.

* cited by examiner

*Primary Examiner*—Aaron J. Lewis
(74) *Attorney, Agent, or Firm*—Connolly, Bove Lodge & Hutz

(57) ABSTRACT

Means are provided for connecting at least one breathing gas cylinder to a face mask or like device in breathing equipment of the kind used by firemen and divers, for instance. The means includes a three-way coupling (5) in which at least one of the connections is comprised of a hose connector (10) which can be adjusted angularly in relation to the two remaining connections (9, 13). The coupling means can be used for different purposes and is relatively insensitive to external influences.

6 Claims, 2 Drawing Sheets

CONNECTING DEVICE FOR A BREATHING APPARATUS

Figure 1:
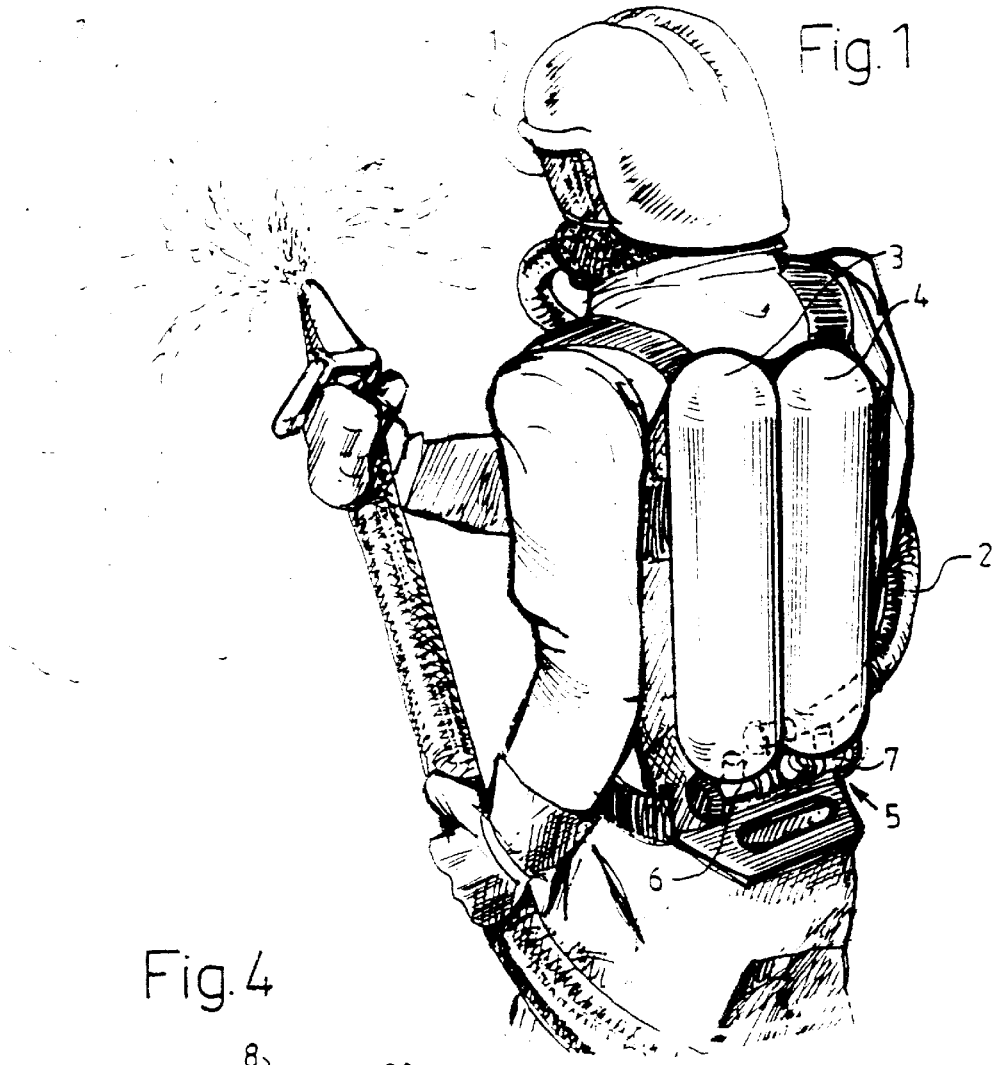

The present invention relates to means for connecting at least one breathing gas cylinder to a face mask or the like in breathing equipment of the kind used by fireman and divers, for instance.

Very high requirements are placed on breathing equipment of the kind normally used in difficult and dangerous circumstances. In particular, such breathing equipment must be easy to handle and to be safe and reliable in use. Such equipment shall also be capable of withstanding rough treatment and must be flexible in solving problems that arise in emergency situations.

The breathing gas is normally obtained from a back-carried gas cylinder which when full can have a pressure of 300 bars. The equipment includes one or more pressure regulators by means of which the air pressure is lowered to an overpressure corresponding to about 245 Pa (25 millimeters water column) when entering a face mask, mouthpiece or the like.

Depending on the type of working operation concerned, the user of the equipment will carry either one single air supply cylinder or two mutually connected cylinders, this latter in order to extend the working capacity of the equipment. When only a single cylinder is used, it is desirable to be able to quickly refill the cylinder as the need arises with the cylinder constantly connected to the breathing equipment. When using a single gas tube, it should be possible in emergency situating to connect the cylinder temporarily to, corresponding breathing equipment carried by another person. When using two cylinders, the cylinders will preferably be mutually connected with the aid of a device which will permit the relative positions of the cylinders to change and enable cylinders of mutually different diameters to be used.

The main object of the present invention is to provide simple and reliable means for connecting at least one gas cylinder to a face mask or like device, the means being constructed to fulfil the aforesaid requirements, among others. The connection means shall also be relatively insensitive to external forces.

WO 95/03092 discloses a means for coupling a breathing gas cylinder to a face mask wherein at least one of the coupling connectors can be adjusted angularly in relation to the remaining connector. However, a connector not used may cause problems in certain situations as it can not be pivoted to a protected parking position.

According to the present invention, these objects are achieved by the means for coupling at least one breathing gas cylinder to a face mask as described hereinafter.

The fact that not all connections are fixed enables the connector means to be connected-up more easily when two cylinders are both to be connected commonly to a breathing mask. Among other things, the cylinders need not necessarily be fully parallel with one another or located at precisely the same height. The inventive connector means also enables cylinders of different diameters to be used together. Furthermore, the connectors means also provides from a safety aspect the very important advantage of enabling abrupt movements of the gas cylinders to be taken up by the connector means with no risk of leakage that would otherwise occur if the cylinders were to be rigidly connected together. Such abrupt movement of the cylinders may be the result of careless handling of the cylinders, for instance dropping the cylinders onto the floor so as to cause the cylinders to shift relative to one another.

When only one single gas cylinder is connected to the air supply system and the additional angularly adjustable pipe connection is intended to be used to quickly replenish the cylinder or to enable further breathing equipment to be connected to the cylinder, the ability of being able to pivot the pipe connection to ba protected packing position when not used for the aforesaid purpose is of great benefit.

Particularly advantageous embodiments of a connector means described hereinafter.

Figure 4:
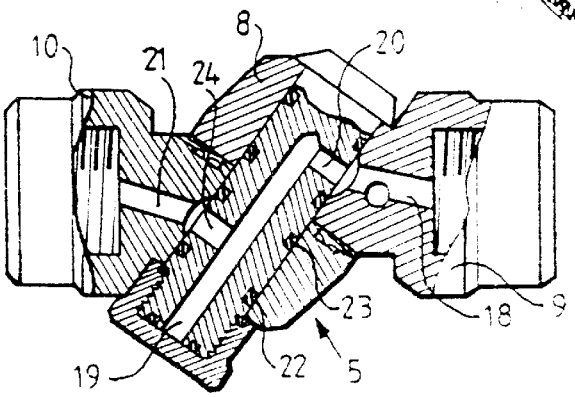
Figure 5:
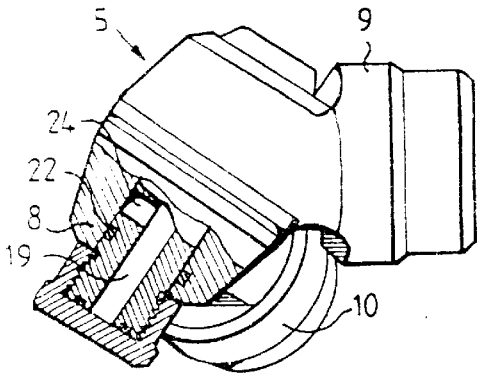
Figure 2:
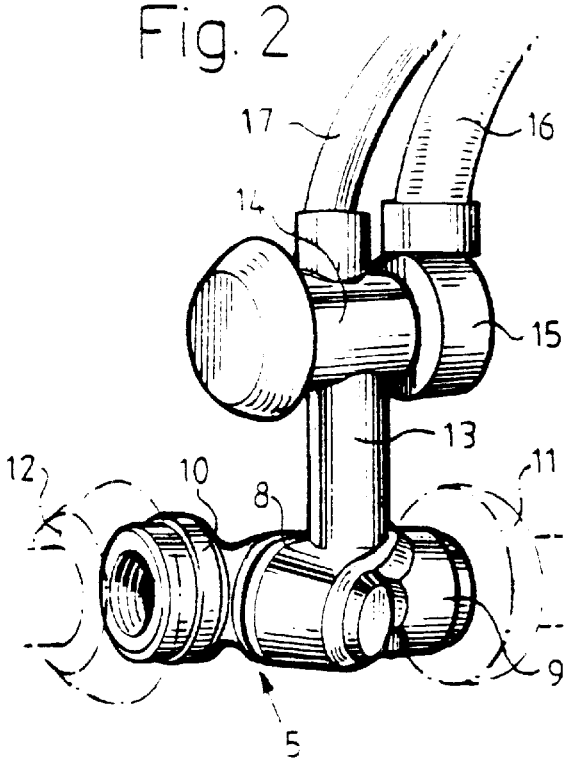
Figure 3:
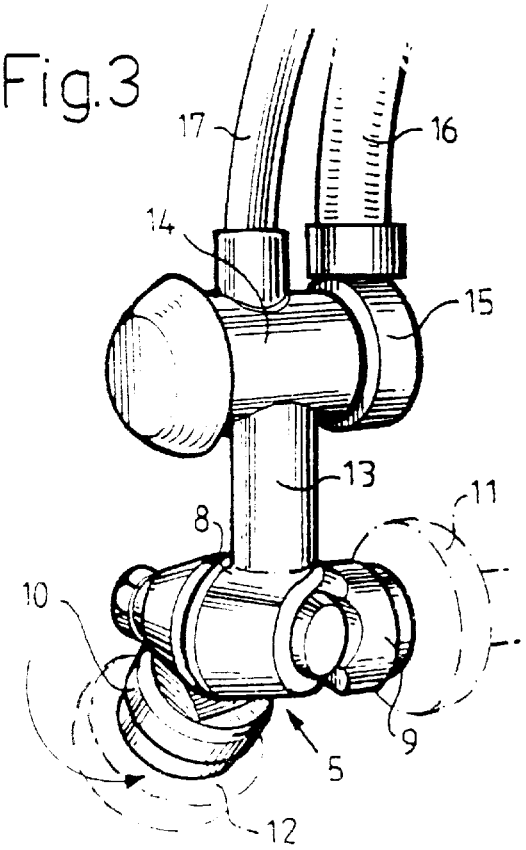

The invention will now be described in more detail with reference to exemplifying embodiments thereof and also with reference to the accompanying drawings, in which FIG. 1 illustrates a fireman using breathing equipment which includes an inventive connector means;

FIGS. 2 and 3 illustrate the inventive means in two different operational states; and FIGS. 4 and 5 illustrate the connector means for FIGS. 2 and 3 from beneath and partly in section.

The fireman shown in FIG. 1 wears breathing equipment which includes a face mask 1 to which breathing gas is supplied through a hose 2 from two gas cylinders 3 and 4 connected to the hose in parallel. The gas cylinders are connected to the hose 2 through the media of a T-coupling 5 having separate valves 6 and 7 for respective cylinders.

The T-coupling used includes two hose connectors 9 and 10 which project out from a tubular main body 8, see FIGS. 2–5. The hose connector 10 can be adjusted angularly with relation to the other hose connector 9.

When using two gas cylinders 3, 4 in accordance with FIG. 1, each cylinder is connected to its associated hose connection 9 or 10, these hose connections then being in the positions shown in FIGS. 2 and 4. Because of the hose connectors is pivotable, i.e. the hose connector 10, the cylinders can be readily connected to the breathing air system even when the cylinders are not fully parallel with one another or are not positioned at precisely the same heights. The coupling means also enables cylinders of mutually different diameters to be connected together. A fixed T-coupling would not afford these advantages, but would require the use of flexible hoses to this end. The use of hoses, however, it risky because the hoses become worn and age.

FIG. 2 illustrates a manner in which the fixed hose connector 9 can be connected to the gas cylinder 4 through the medium of a coupling 11, and also illustrates a manner in which the movable hose connector 10 can be connected to the gas cylinder 3 through the medium of a further coupling 12.

Another important advantage afforded by the use of at least one movable hose connector is that the coupling means is less sensitive to careless handling. For instance, if the cylinders are dropped onto the floor while mutually connected by a fixed T-coupling, leakage is likely to occur. When using an inventive coupling means, such damage is likely to be avoided in such cases by virtue of any movement between the cylinders being take-up by pivotal or rotary movement of the movable hose connector.

As will be seen from FIGS. 2 and 3, the tubular main body 8 of the illustrated embodiment is connected to a first pressure reducer 15 through the medium of a fixed pipe connection 13 and a connection piece 14. The pressure reducer 15 is connected to the face mask 1 through the medium of a hose 16 and a second pressure reducer (not shown), such that breathing gas will be delivered to the face mask at a pressure corresponding to about 25 millimeters water column. The reference numeral 17 identifies a conductor which can be used to deliver pressure signals and warning signals when the pressure in the gas cylinder or cylinders connected thereto falls to given value.

The inventive coupling means has been described in the aforegoing with reference to the use of two gas cylinders. It will be understood, however, that the inventive coupling means also affords important advantages when only one cylinder is used, which is then conveniently connected to the fixed hose connector 9. The movable hose connector 10 can then be used to quickly replenish the single gas cylinder without needing to disconnect the cylinder from the breathing gas system. For instance, the movable hose connector can be used to quickly recharge the gas cylinder while briefly interrupting a working operation which will take longer to complete than the time allowed by the gas content of a single cylinder.

When using only one cylinder, the free hose coupling means enables a further face mask to be connected to the same cylinder in an emergency and when so required.

Because the free hose connector 10 is pivotable, it can be rotated to a parking position in which it is protected from external influences when not in use, see FIGS. 3 and 5. This facility is highly significant, since the breathing equipment is often used under difficult conditions in which an outwardly projecting hose connector of a fixed T-coupling may easily be damaged.

In the illustrated embodiment, the movable hose connector 10 can be rotated or pivoted through about 110° about an axis which defines an acute angle with the longitudinal axis of the hose connector. As a result, the parking position will be located beneath and obliquely inwardly of the tubular main body 8, where it is well protected.

FIGS. 4 and 5 illustrate a manner in which the coupling means 5 may be constructed to achieve the aforedescribed functions.

In the illustrated case, the hose connector 8 is fixed on the tubular main body 8, wherein the center passageway 18 of the connector 9 is connected to the center passageway 19 of the tubular body by a radial passage 20.

The movable hose connector 10 is pivotable about the longitudinal axis BB of the main body 8, wherein the center passageway 21 of the hose connector 10 is connected with a space which is surrounded by the main body and is sealed with two O-rings 22, 23 and which communicates with the central passage 19 of the main body through the medium of a radially extending passage 24.

Because the two hose connectors 9 and 10 have a longitudinal axis illustrated by a straight line A—A when in a first operational position, the line A defining an acute angle with the longitudinal BB of the main body 8, as shown in FIG. 4, two diametrically opposed hose couplings can be connected to the main body with the hose connections 9 and 10 spaced apart at an angle of 180°. As described above, the hose connector 10 can be rotated relative to the main body 8 in this position, while maintaining communication with the center passage 19 of the main body.

When the movable hose connector 10 is not to be used, the connector can be turned through 110° to the protective packing position, as illustrated in FIG. 5.

Although the invention has been described in the aforegoing with reference to an illustrated exemplifying embodiment thereof, it will be understood that several modifications can be made within the scope of the following Claims. For instance, both of the hose connectors can be made movable in relation to the main body if so desired. Furthermore, other types of swivel couplings can be used to achieve the desired mobility of one or both hose connectors.

What is claimed is:

1. Coupling means for coupling breathing gas cylinders to breathing equipment, the coupling means being mountable at an end of the cylinders, and comprising a pair of coupling connectors which, in a first operational position, are in a straight line and connectable to two parallel gas cylinders, and a third coupling connector at an angle to said straight line and connectable to a breathing gas conduit leading to said breathing equipment; wherein said pair of coupling connectors are mounted on a tubular main body having a longitudinal passageway which communicates with passageways through each of said coupling connectors; wherein a longitudinal axis of said tubular main body defines an arcuate angle with said straight line defines by said pair of coupling connectors in said first operational position; wherein at least one of the connectors of said pair of coupling connectors is pivotable about said tubular main body independently of the other connector of said pair, from said first operational position to a second protected parking position, wherein the coupling means is a T-coupling having two connectors which project out from a tubular main body and connect with a passageway in said body, and wherein at least one of the connectors can be adjusted angularly, wherein the passageway in the tubular main body is connectable with a face mask; wherein the other of the connectors is fixed and connects with a breathing gas cylinder; and wherein the pivotable connector is available for connection to a cylinder replenishing conduit, a further breathing gas cylinder or corresponding breathing equipment carried by another person.

2. Means according to claim 1, wherein the pivotable connector is pivotable about the longitudinal axis of said tubular main body.

3. Means according to claim 2, wherein said means is connected to a high pressure line from a breathing gas cylinder and to a face mask through the medium of at least one pressure regulator.

4. Means according to claim 2, wherein the coupling is a T-coupling means having two connectors which project out from said tubular main body and connect with a passageway in said body, and wherein at least one of the connectors can be adjusted angularly.

5. Means according to claim 1, wherein said means is connectable to the high pressure line from the breathing equipment and to a face mask through the medium of at least one pressure regulator.

6. Means according to claim 5, wherein the coupling is said T-coupling means having two connectors which project out from a tubular main body and connect with a passageway in said body, and wherein at least one of the connectors can be adjusted angularly.

* * * * *